US005848632A

United States Patent [19]

Chou

[11] Patent Number: 5,848,632

[45] Date of Patent: Dec. 15, 1998

[54] POSITIVE CLOSE VERTICAL BLIND SYSTEM

[76] Inventor: Tser-Wen Chou, 19464 Via Del Caballo, Yorba Linda, Calif. 92686

[21] Appl. No.: 825,648

[22] Filed: Apr. 3, 1997

[51] Int. Cl.[6] ..... E06B 9/38

[52] U.S. Cl. ..... 160/168.1 V; 160/176.1 V; 160/900

[58] Field of Search ..... 160/168.1 V, 173 V, 160/176.1 V, 177 V, 344, 115, 178.1 V, 900

[56] References Cited

U.S. PATENT DOCUMENTS

| | | | |
|---|---|---|---|
| 2,807,322 | 2/1957 | Toti . | |
| 3,038,534 | 6/1962 | Clayton . | |
| 3,068,938 | 12/1962 | Hull . | |
| 3,208,507 | 9/1965 | Breen | 160/176.1 V X |
| 3,500,896 | 3/1970 | Endou | 160/173 V X |
| 4,103,727 | 8/1978 | Horst Spohr . | |
| 4,254,813 | 3/1981 | Vecchiarelli . | |
| 4,291,738 | 9/1981 | Grenga et al. . | |
| 4,293,021 | 10/1981 | Arena | 160/173 V X |
| 4,316,493 | 2/1982 | Arena . | |
| 4,335,775 | 6/1982 | Frentzel . | |
| 4,662,422 | 5/1987 | Anderson | 160/168.1 V |
| 4,869,309 | 9/1989 | Evans . | |
| 4,919,185 | 4/1990 | Comeau et al. . | |
| 4,921,031 | 5/1990 | Wagner et al. . | |
| 5,647,422 | 7/1997 | Weng | 160/176.1 V |

*Primary Examiner*—David M. Purol
*Attorney, Agent, or Firm*—Curtis L. Harrington

[57] ABSTRACT

An improved system utilizes a series of structures which permit magnetic closure to be used in existing carriers and components. Magnetic support structures include members which ride in the carrier, as well as special size members which mount in the lead or wand carrier and which reside in the vertical blind track end caps. All of the structures are installable as retro-fit and which can work with existing tracks, carriers and end caps, even though these structures have been optimized for small size.

12 Claims, 11 Drawing Sheets

POSITIVE CLOSE VERTICAL BLIND SYSTEM

FIELD OF THE INVENTION

The present invention relates to the field of window coverings and more particularly for improvements in vertical blinds which enables a multi - section structure to achieve complete closure.

BACKGROUND OF THE INVENTION

Conventional vertical blind systems are set up for a single expansive spread across a single panel. The vertical panels and their carriers are set for a spaced relationship, but forming closure depends upon each of the spacing members allowing each of the vertical units to reach their exact spacing. At the end of the closure travel, any spacing member which has not enabled a full spaced relationship can hold the end carrier back. Since the blinds are usually high up and operated by wand, the user does not have high positive mechanical advantage which would always allow a good closing force.

Even where the force can be applied, the end carrier may not remain at its terminal position and may move away from full closure. This characteristic makes vertical blinds less than an optimum choice for audio visual rooms where the outside light needs to be completely blocked out. One technique involves the provision of up to a 0.5 inch overlap as a sum of overlap with respect to all of the carriers so that there will be adequate coverage. As the overlap increases, even a full closure can result in a noticeable uneven spacing of the individual vertical blind units.

Even where no sticking occurs, the user can bounce the end carrier against the end of the rail causing it to bounce back. Even at best, the user is required to "fuss" with the vertical blind unit to get it to close completely.

These problems just mentioned are bad enough for single panels having a single one directional coverage, and illustrate why workable two direction coverage is practically impossible. Two direction coverage, where the blinds close toward each other at the center of a panel, would require that the two end carriers meet and remain together. The problems are exacerbated where the bringing of one carrier to another would result in the second carrier being bumped away. The user would have to manipulate two control wands together placing a bending force on them. The two carriers, even if brought together would be urged apart by the swinging vertical blind units which are suspended from them.

For longer window spaces, conventional vertical blinds are provided in shorter sections. Conventional vertical blind sets are provided as a series of short sections which all close in one direction. A long run of single extrusion has not been possible for several reasons, including: (1) the rotation rod would sag, and (2) specialized end plate structures would be necessary to end closure by one lead carrier and to start another section. A longer single run would be desirable where the user could change configurations more easily.

What is therefore needed is a manner of forming positive closure in order that vertical blinds may be closed securely, exactly and precisely with regularity. The closure mechanism should be highly integratable with existing track systems and vertical blind carriers. The system should provide for a distributed system of support which will support any tendency of the rotation rod to sag. The system should provide positive feedback to the operator that the blinds are securely closed.

SUMMARY OF THE INVENTION

The improved system utilizes a series of structures which permit magnetic closure to be used in existing carriers and components. Magnetic support structures include members which ride in the carrier, as well as special size members which mount in the lead or wand carrier and which reside in the vertical blind track end caps. All of the structures are installable as retro-fit and which can work with existing tracks, carriers and end caps, even though these structures have been optimized for small size.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
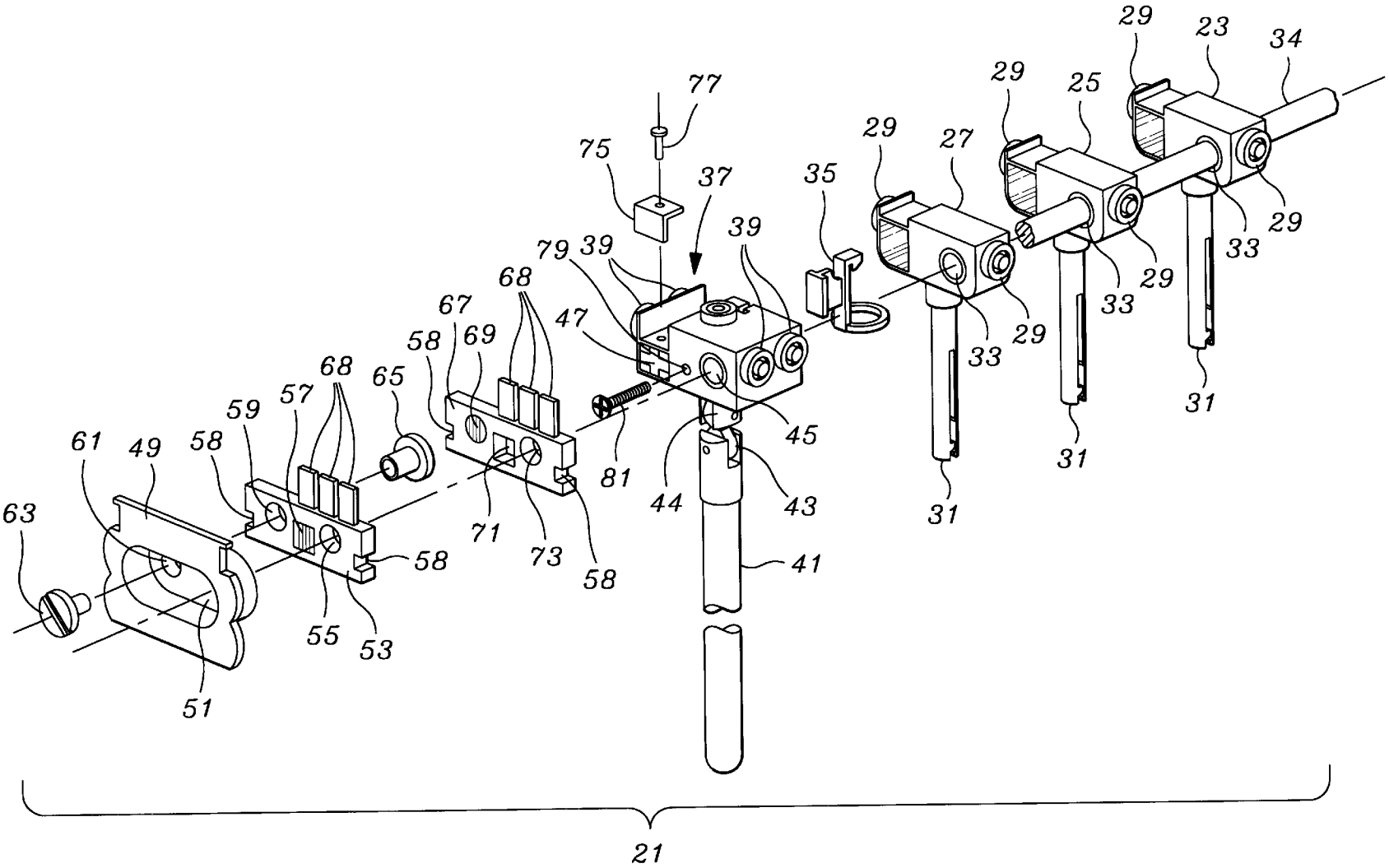
FIG. 1 is a distributed perspective view of the components of a first system using a pair of flat members and shown in a single direction opening format, with respect to the end of a direction of travel for a track system.

The description and operation of the invention will be best described with reference to a prior art configuration which shown in FIG. 1. FIG. 1 is perspective partially exploded, distributed view illustrating a system 21 made up of structures which would normally be supported by a track or rail unit (not shown) which is the structure which is mounted to a ceiling or side surfaces of a window. Beginning at the far right a series of three follower carriers 23, 25 and 27 are seen. Each of the follower carriers 23, 25, & 27 have a pair of rolling wheels 29 which would ride on an internal raceway within the track (not shown). Each of the follower carriers 23, 25, & 27 have a downwardly extending rotatable blind support 31 which vertically supports and rotatably actuates vertical blinds (not shown) attached thereto, in the horizontal plane.

Each of the follower carriers 23, 25, & 27 have a gear structure which operates from an internal rotatable sleeve 33, partially seen in FIG. 1. The internal rotatable sleeves 33 are engaged by a rotatable rod 34 which extends through all of the rotatable sleeves 33 and along which all of the follower carriers 23, 25, & 27 can slidably translate from a closed position where all of the follower carriers 23, 25, & 27 are grouped to the side and an open position where all of the follower carriers 23, 25, & 27 are fully extended with maximum spacing between them. Only a small section of the rotatable rod 34 is shown. Although only three follower carriers 23, 25, & 27 are shown, most applications will have between 15 to 30. Also shown is a connector link 35 which connects the closest follower carrier 27 to closely follow and move with a lead carrier 37. It has a slot portion which engages the lead carrier 37 and a ring portion which engages the downwardly extending rotatable blind support 31. Not shown are the spacing links extending between individual follower carriers 23, 25, & 27 which enable an exact spacing to be set, yet which enable the follower carriers 23, 25, & 27 to move to a compressed position immediately adjacent each other.

To the left of the follower carriers 23, 25, & 27 the lead carrier 37 has two pairs of wheels 39 on each side of the lead carrier 37 which provides for greater stability. A wand 41 is connected to the lead carrier 37 through a fitting 43 to allow a turning of the wand 41, even though oriented at a non vertical angle, to transmit turning forces to the lead carrier 37. The fitting 43 is attached to a turning rod 44. Turning forces from the wand 41 translate into a turning force through the fitting 43 and turning rod 44 to an internal fitting 45 to turn the rotatable rod (not shown) which extends through all of the rotatable sleeves 33, to thus actuate each of the follower carriers 23, 25, & 27.

Conventional lead carriers 37 have a number of physical features. First, they usually have a split housing which has a set of locking fingers (not seen) within a locking finger bore 47. The locking fingers (not seen) have a configuration as a meeting pair of prong shaped members which approach each other at a right angled difference in rotational orientation and lock together producing a cross or "+" shaped locking finger bore 47 which extends completely through the lead carrier 37.

Referring to the far left of FIG. 1, a conventional end cap 49 has an oval depression 51. The end cap 49 is typically injection molded as a single piece of plastic. The materials and structures thus far described are present in most conventional carriers. The other structures seen in FIG. 1 and which are about to be described enable the system 31 to form a positive closure.

Adjacent the end cap 49 is a first flat member 53 which is intended to fit closely to end cap 49. First flat member 53 has a first bore 55 to accommodate the rotatable rod (not shown). At the center of the first flat member 53, is a magnet 57 which extends through the first flat member 53 to the other side. The first flat member 53 has a pair of slide slots 58 which will engage the tip ends of the raceways (not shown) of the track (also not shown) to help the first flat member with its support. First flat member 53 has a second bore 59. An aperture 61 exists in the end cap 49 to permit a threaded rivet set, including a male rivet member 63 and a female rivet member 65 to extend through the aperture 61, and second bore 59 in order to affix the first member 53 closely adjacent the end cap 49.

Adjacent first flat member 53 is a second flat member 67, which has structure to accommodate first flat member 53, as will be shown. Second flat member 67 is shown with a series of upward projections 68 and is intended to travel along with the motion of the lead carrier 37 at least partially along the track (shown later). The upward projections 68 are shown as 3, but may be more. Each can be broken off to enable a space to exist between the upper part of the projection 68 and the top of the track (shown later). Screws inserted in the track at various positions lateral to the track will stop a second flat member 67 having an upward projection 68 meeting it to separate it from its magnetic attraction with the lead carrier 37. With three upward projections 68, a series of three screws can be used to spatially disperse three such flat members 67 along a vertical blind system as the lead carrier 67 is moved to open and move back the vane members.

For each second flat member 67 left behind, the engagement of the side slots 58 with the race of the extrusion or track and the engagement of the through bore 73 with the rotatable rod 34 contributes to the support for rotatable rod 34.

A series of traveling second flat members 67 may be provided, each having a magnet 69 for mutual attachment. The magnet 69 extends through to the second side and thus several identical second flat members 67 can be used. Second flat member 67 also has a central rectangular bore 71 and a through bore 73 to accommodate the rotatable rod (not shown). Unlike the first bore 55 of the first flat member 53, the through bore 73 must be able to slide freely along the rotatable rod (not shown).

To the right of the second flat member 67, a metal plate 75 has an "L" shape and is attachable to the lead carrier 37 at the bottom horizontal portion of the "L" with a rivet 77. The vertical portion of the "L" shape of the metal plate 75 covers the locking finger bore 47. To the right of the locking finger bore 47 is a screw accommodation bore 79, which is provided to fit an elongate screw 81.

As can be seen, the structures must be compact to enable full closure of the lead carrier 37. All of the metal portions recited are ferromagnetic and thus with the magnetic portions help concentrate and transmit lines of magnetic flux. These structures, including magnets 57 & 69, include male rivet member 63, female rivet member 65, metal plate 75, and an elongate screw 81. The resulting structure is preferably formed with a magnetic polarity creating an oval flux. For example, assuming the end of magnet 69 facing the viewer is North, this polarity is transmitted through the female rivet member 65, male rivet member 63, the lines of flux traveling through air and re-entering the end of magnet 57 having a south polarity. The north pole of magnet 57 would connected with the end of the elongate screw 81, the lines of flux then traveling through the air to the plate 75 and then to the south pole of the magnet 69. This provides some holding synergy even though the structure is limited by two somewhat flat axial length magnets 57 and 69.

The operation of the system 21 will involve the manual actuation by the wand 41 of the lead carrier 37 close enough to the end cap 49 to enable the magnets 57 and 69 to magnetically attach to the adjacent metal members including male rivet member 63, female rivet member 65, metal plate 75, and an elongate screw 81. The clicking into place of the lead carrier 37 against the end cap 49 will provide positive reinforcement to the user, letting the user know that the system 21 has traveled to the closed position to its maximum extent.

Figure 2:
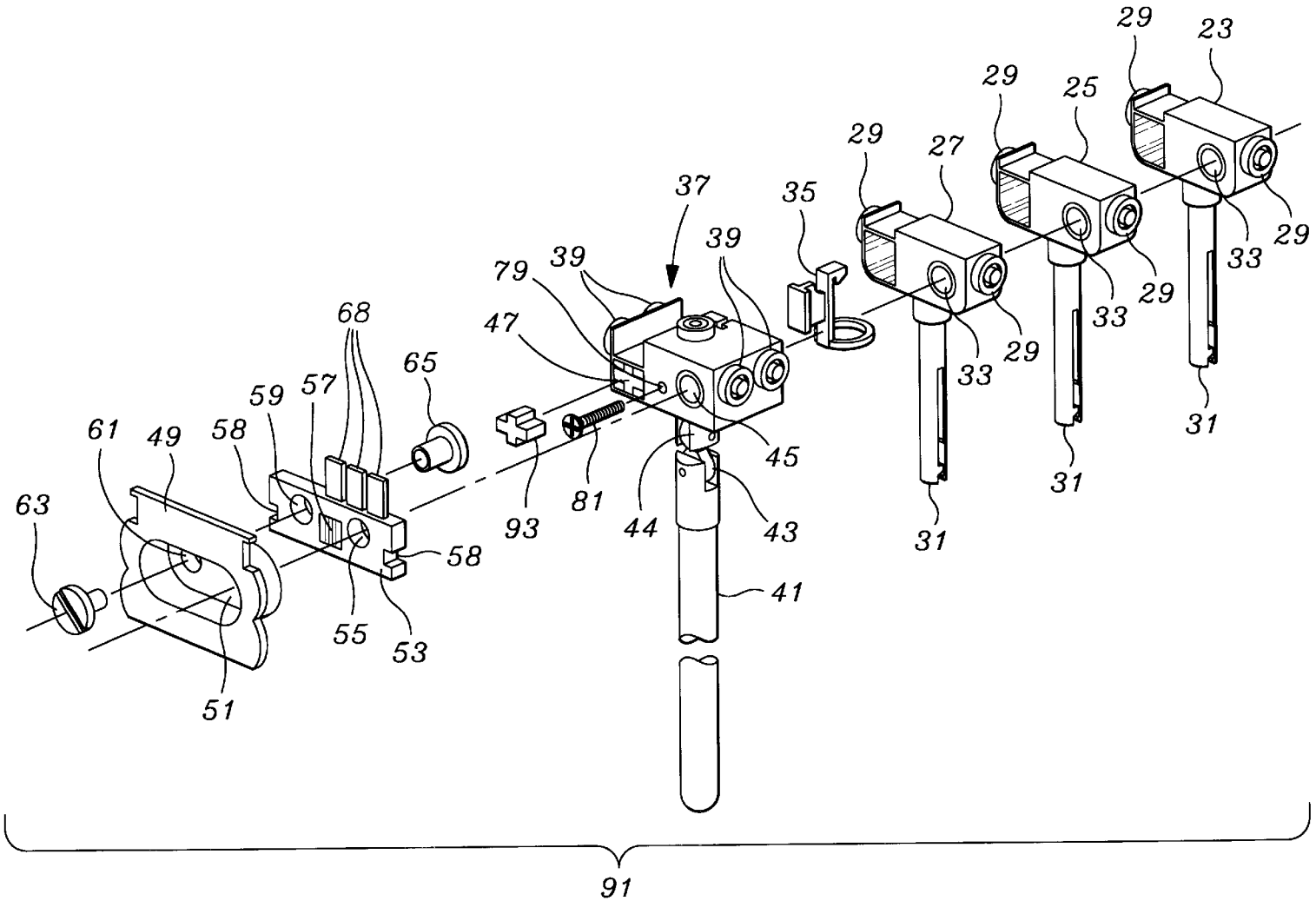
FIG. 2 is a distributed perspective view of the components of a second system using an end rivet securing a single flat member, working in conjunction with a magnet fitted within the lead carrier, and shown in a single direction opening format, with respect to the end of a direction of travel for a track system.

Referring to FIG. 2, a second configuration of a system 91 which is numbered the same as FIG. 1 with the exception that the second flat member 67, metal plate 75, and rivet 77 are not present. In addition, a magnet 93 having a cross "+" shaped cross sectional shape is in position to be inserted within the locking finger bore 47. In this configuration, if the end of magnet 93 facing the observer has a North polarity, the lines of magnetic flux will pass through (as the magnet 93 touches) the female rivet member 65, male rivet member 63. The lines of flux then travel through air and re-entering the end of magnet 57 having a south polarity. The north pole of magnet 57 would connect with the end of the elongate screw 81 (which need not be as long since the second flat member 67 is not present), the lines of flux then traveling through space through the lead carrier 37 and then to the south pole of the magnet 93.

Figure 3:
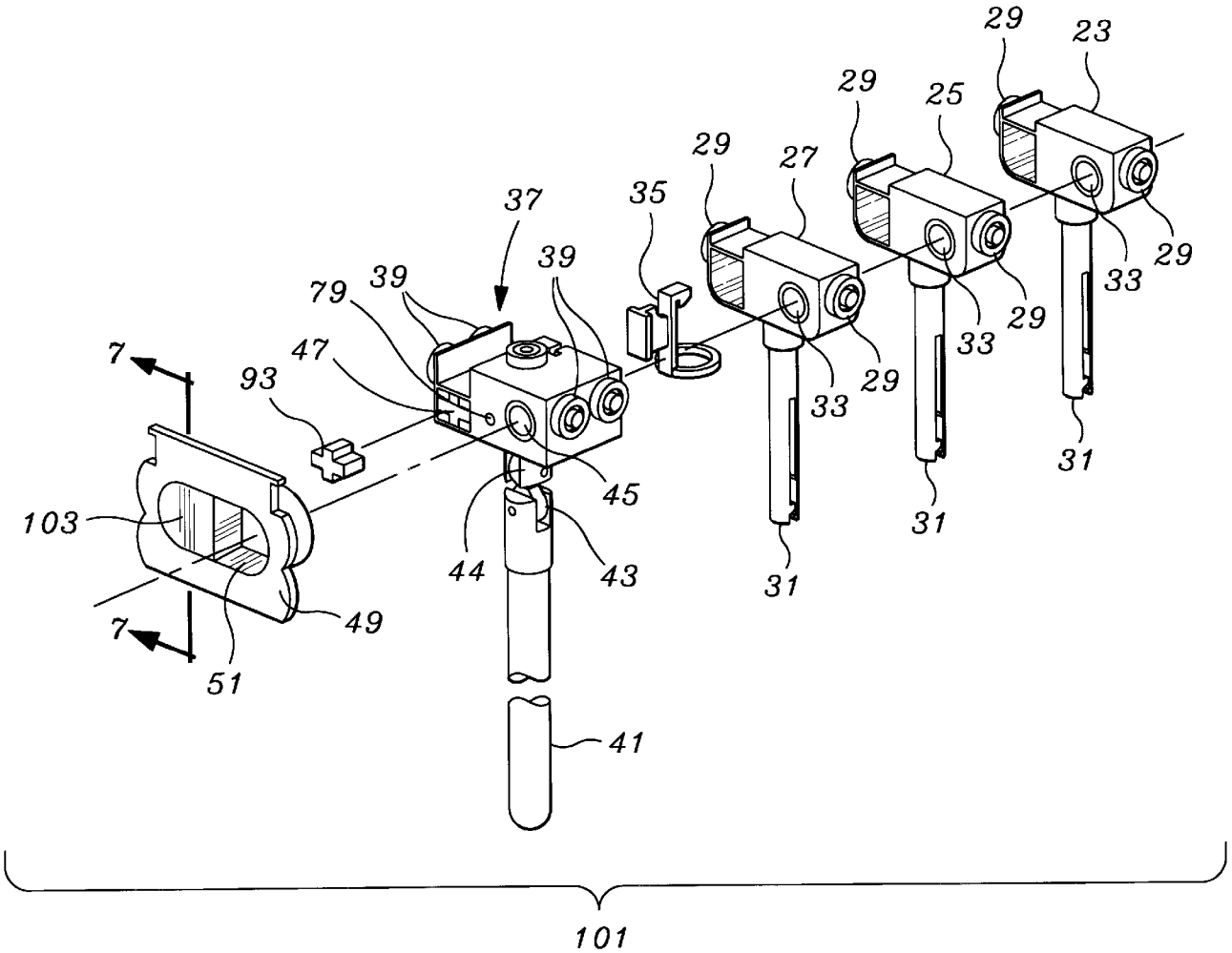
FIG. 3 is a distributed perspective view of the components of a third system using a "D" shaped magnet carried in an end cap and working in conjunction with a magnet fitted within the lead carrier, and shown in a single direction opening format, with respect to the end of a direction of travel for a track system.

Referring to FIG. 3, a third configuration of a system 101 which is numbered the same as FIG. 2 with the exception that the male rivet member 63, female rivet member 65, and first flat member 55 is not present.

The oval depression 51 of the conventional end cap 49 now supports a "D" shaped magnet 103 which occupies about half of the area within the oval depression 51. Since the material of the oval depression 51 is thin, an aperture similar to the aperture 61 will probably not be necessary. If an aperture were necessary, it should be formed so as to prevent magnet 103 from passing through such an aperture, but at the same time making sure that enough of the surface area of the magnet 103 is available for contact with the exposed end surface of magnet 93. This will give a more positive "click" when the lead carrier 37 is brought securely against the end cap 49. This configuration has no concern for a double looping path for lines of magnetic flux since only two magnets are used, but in this case the magnets 103 and 93 are brought into direct contact which will result in a much more secure and powerful holding connection. The magnet 103 may also be press-fit and possibly glued within the oval depression 51.

Figure 4:
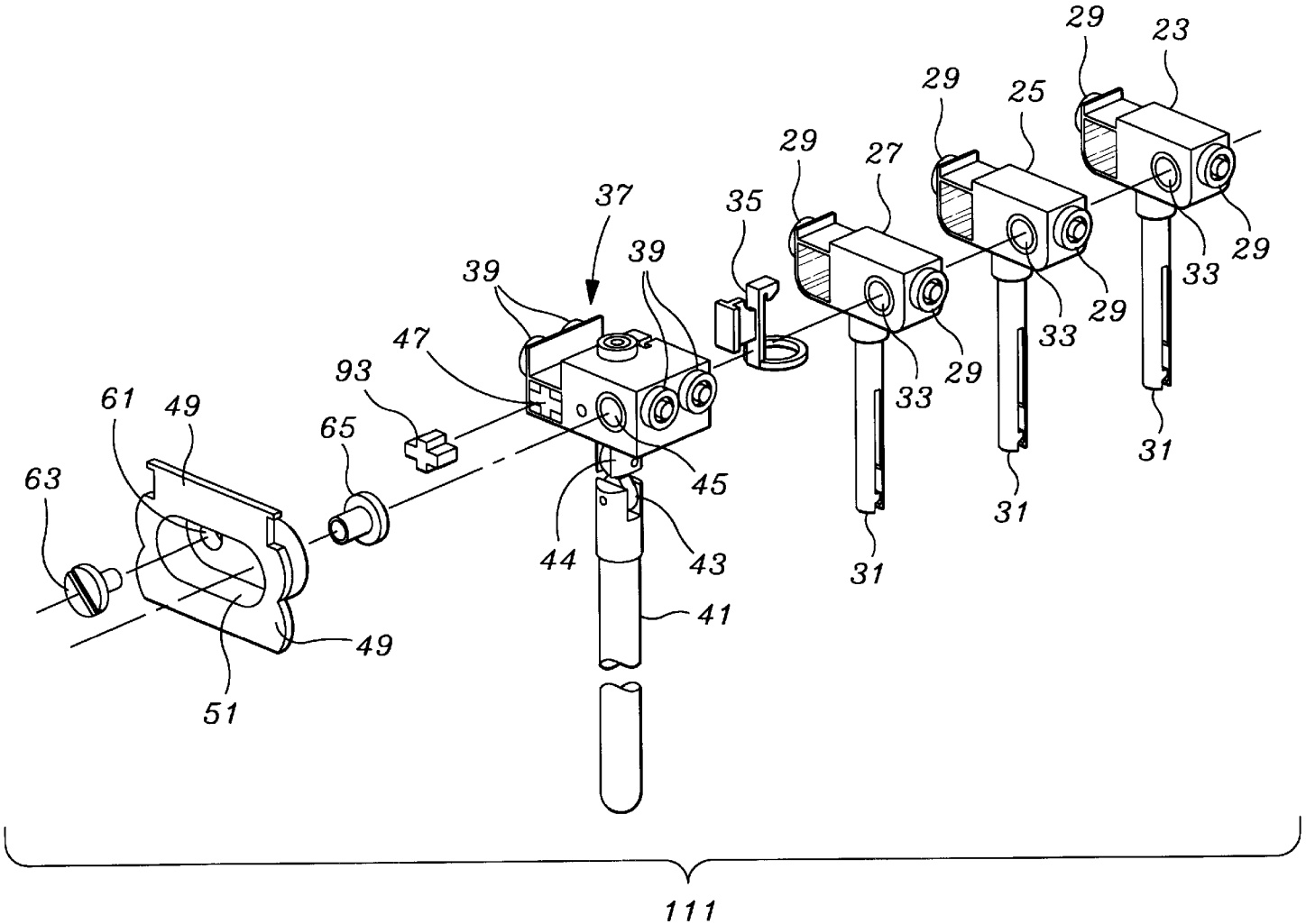
FIG. 4 is a distributed perspective view of the components of a fourth system using a rivet secured to an end cap and working in conjunction with a magnet fitted within the lead carrier, and shown in a single direction opening format, with respect to the end of a direction of travel for a track system.

Referring to FIG. 4, a fourth configuration of a system 111 which is numbered the same as FIG. 3 with the exception that the male rivet member 63, female rivet member 65, are re-introduced in place of the magnet 103 with the magnetic connection between the magnet 93 and rivet members 63 and 65 forming the sole magnetic holding connection. The iron content of the rivet members 63 and 65 have to be high enough to enable the magnet 93 to hold the lead carrier 37 against the end cap 49.

Figure 5:
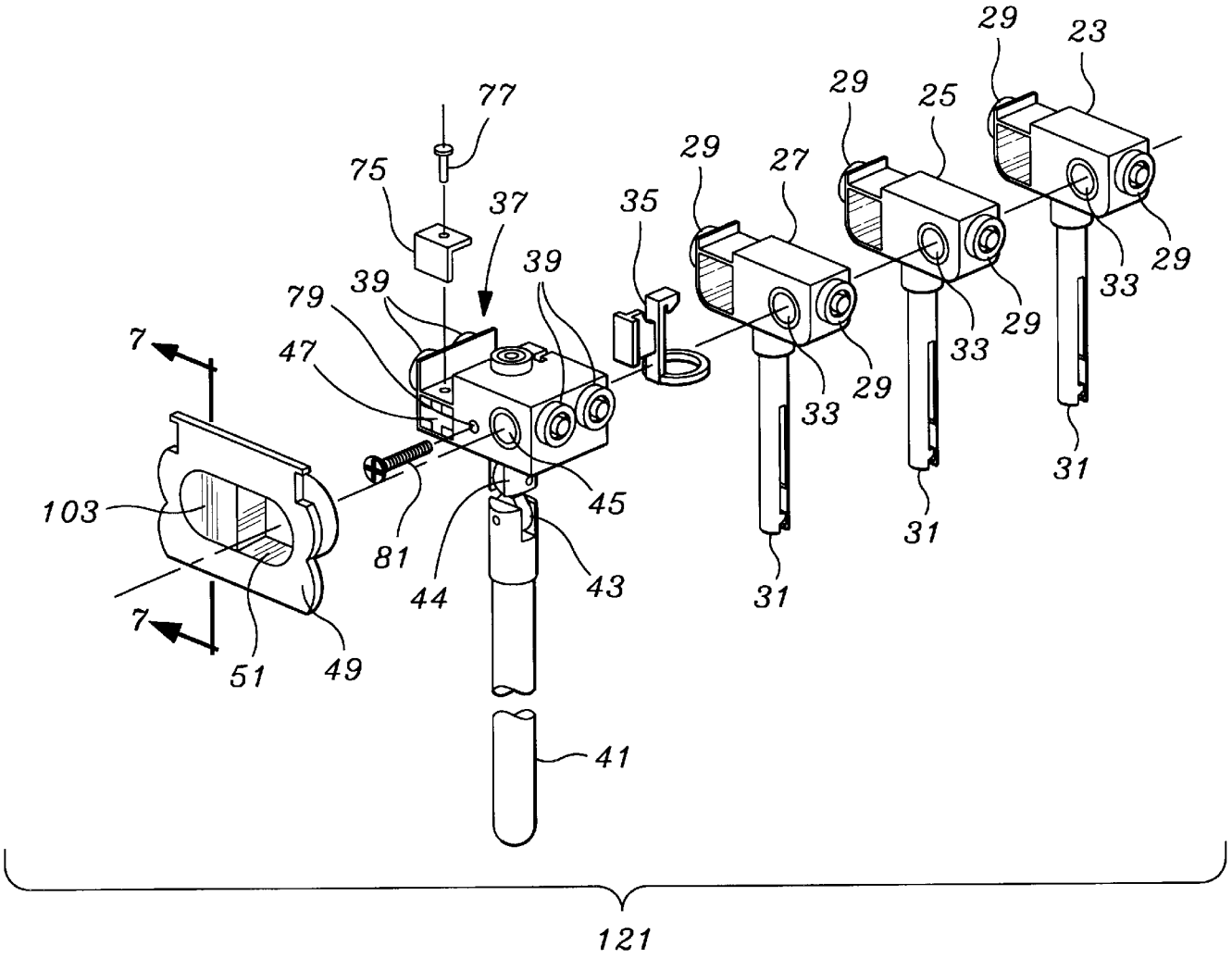
FIG. 5 is a distributed perspective view of the components of a fifth system using a "D" shaped magnet carried in an end cap and working in conjunction with a plate mounted upon the lead carrier, and shown in a single direction opening format, with respect to the end of a direction of travel for a track system.

Referring to FIG. 5, a fifth configuration of a system 121 is a combination of the end cap 49 and magnet 103 of FIG. 3, along with the right portion of FIG. 1 beginning with the metal plate 75. All numbering of the structures are equivalent. In operation, the system of FIG. 5 provides magnetic, and preferably touching contact between the magnet 103 and the metal plate 75.

Figure 6:
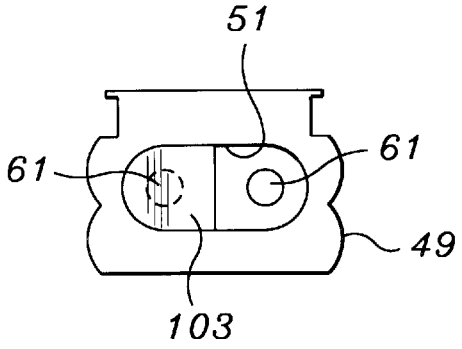
FIG. 6 is an end view of the end cap seen in FIGS. 1–5.
Figure 7:
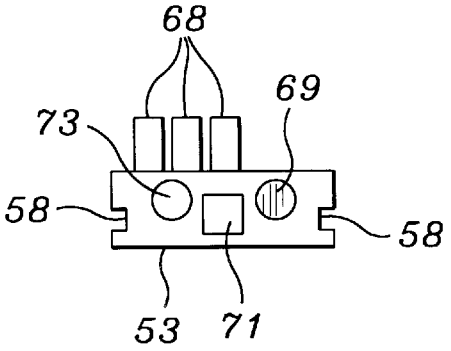
FIG. 7 is a plan view of a first flat member as seen in FIGS. 1 & 2.

For completeness, FIG. 6 shows an end view of the end cap 49 with the magnet 103 in place. FIG. 7 is a view of the back side of the first flat member 53.

Figure 8:
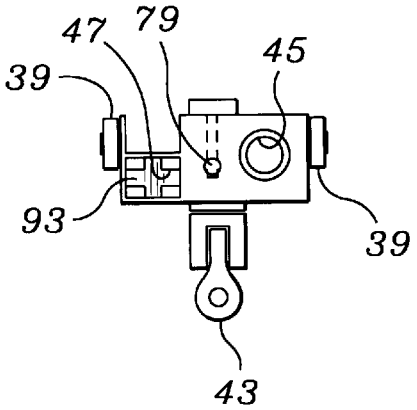
FIG. 8 is a plan view of the lead carrier from a side as seen in FIGS. 1–5.
Figure 9:
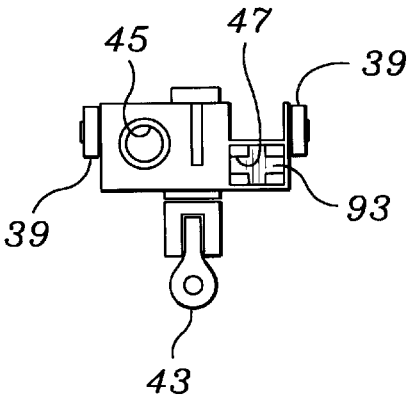
FIG. 9 is a plan view of the other side of the lead carrier as seen in FIGS. 1–5.

FIG. 8 is a view of the lead carrier 37 as also seen in FIG. 3, with the magnet 93 in place within the locking finger bore 47. FIG. 9 is a view of the back side of the lead carrier 37, which is a mirror image of the view of FIG. 8 and which illustrates that the magnet 93 extends completely therethrough. Since the magnet 93 extends completely there through, the lead carrier 37 of FIG. 3 be used with an adjacent carrier 37 to form a carrier—carrier direct magnetic connection, as is shown in FIG. 10.

Figure 10:
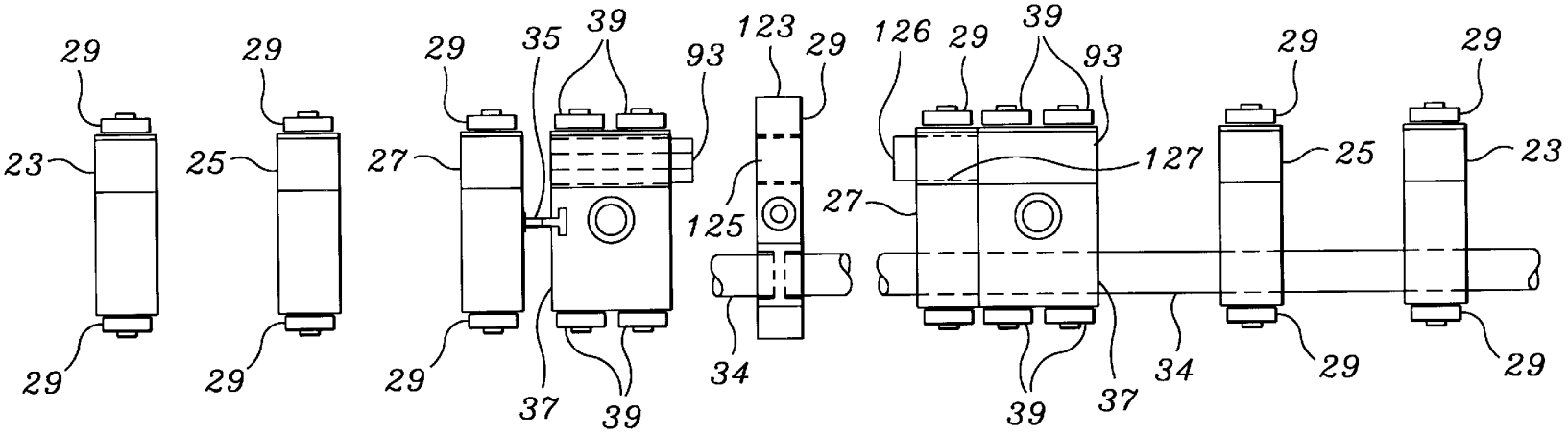
FIG. 10 is a top view of the components cooperating as seen in FIGS. 3 and 4, and shown in a double, opposite direction opening format, with respect to the middle of a pair of opposing directions of travel for a track system.

FIG. 10 is a top view of the members in a middle closure orientation with two lead carriers 37 each having the magnet 93. This configuration is most closely associated with configurations of the lead carrier 37 as seen in FIGS. 2 and 3. The configuration of FIG. 10 further contains a middle fitting 123 which would be attached to the top of the track (to be shown) and would provide a rotating cupped support for the rotatable rods 34 to rotate independently so that one side of the closed vertical blind system 21, 91, 101, 111, or 121 could be operated independently of the other side of the closed vertical blind system 21, 91, 101, 111, or 121. The fitting 123 has an opening or shallow bore 125 to enable magnet 93 to engage a magnet 126 fitted within an aperture 127 in the follower carrier 27. Note that the follower carrier 27 has been moved to the other side of the lead carrier 37 in order to provide vertical blind coverage conveniently to the middle area of meeting of the configuration of FIG. 10.

Figure 11:
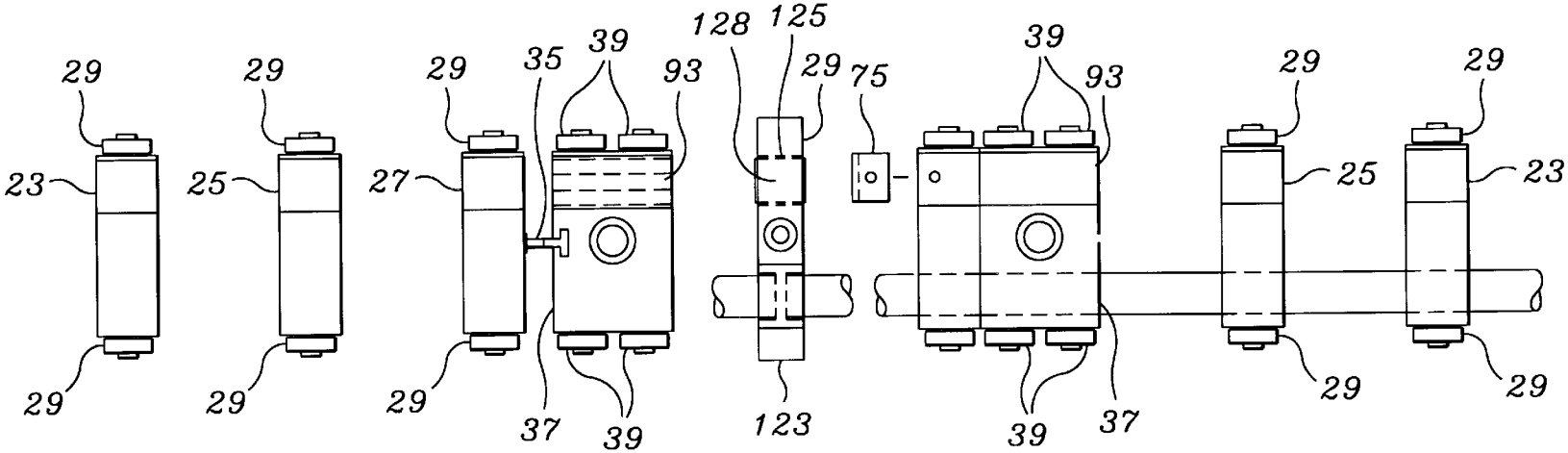
FIG. 11 is a top view of the components cooperating as seen in FIGS. 1 and 3, with one lead carrier having a plate and the other having a magnet and shown in a double, opposite direction opening format.

Alternatively, a carrier 37 as in FIG. 1 with metal plate 75 can be used adjacent a carrier 37 with magnet 93 as was shown in FIG. 3, and this is shown in FIG. 11. The fitting 123 has a magnet 128 within the shallow bore 125 to engage the magnet 93 and a plate 75. FIG. 11 is a top view of the members in a middle closure orientation, with one carrier 37 having a magnet 93 and the other having metal plate 75.

Figure 12:
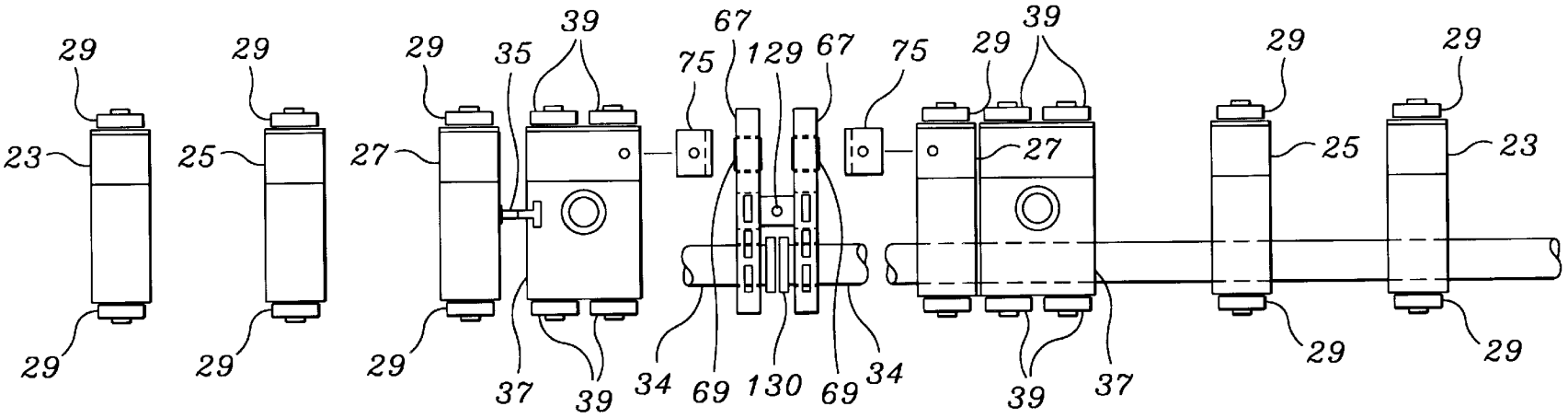
FIG. 12 is a top view of the components cooperating as seen in FIG. 1, with each lead carrier having a plate and two lead carriers working in conjunction with two flat members and shown in a double, opposite direction opening format.

In the alternative, a pair of second flat members 67 can be used together at the center of a track, in conjunction with a pair of lead carriers with metal plates 75 as were shown in FIG. 1. A top view of this configuration is shown in FIG. 12. In this case, the magnets 69 will be oriented North-South North-South, even though separated. A connector 129 is provided to connect the two second flat members 67. The two meeting and independently rotatable rods 34 have an expanded portion 130 which enables the two second flat members 67 to operate as a rotatable support fitting.

Figure 13:
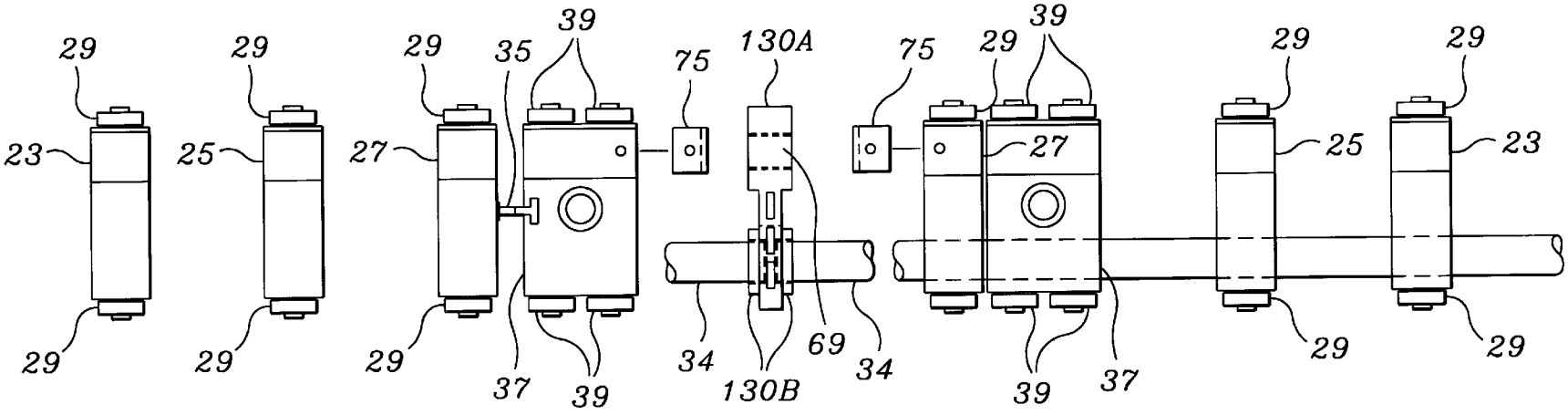
FIG. 13 is a top view of the components cooperating as seen in FIG. 1, with each lead carrier having a plate and two lead carriers working in conjunction with a single flat member and shown in a double, opposite direction opening format.

In the alternative, a single second flat member 67 can be used with a pair of lead carriers 37 as shown in FIG. 1, using a single magnet member at the center to form closure with two carriers 37. A top view of this configuration is shown in FIG. 13. A fitting 130A has a magnet 69 and has a pair of sleeves 130B which assist in holding the two independently rotatable rods 34.

Figure 14:
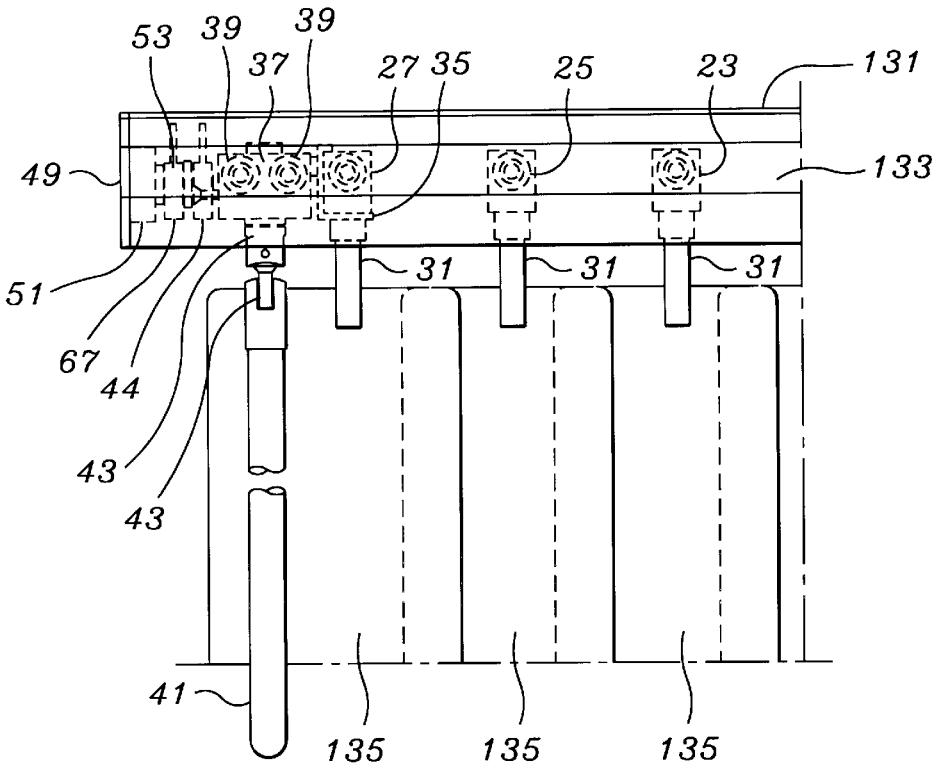
FIG. 14 is a plan view illustrating the invention most closely associated with FIG. 1 in a closed position with a one sided configuration.

The operation of the invention in a one sided configuration will be shown with respect to the configuration of FIG. 1, and it will be shown in FIG. 14. A track 131 is a hollow, inverted "U" shaped channel having a race 133 upon which the wheels 29 and 39 ride. For simplicity, the rotatable rod continues not to be shown. Seen for the first time are vertical blind vanes 135 which are seen to overlap each other as they are shown in the closed position. As is usual, the follower carrier 27 which is most closely adjacent to the lead carrier 37 is attached to move with the lead carrier so that the lead carrier will have coverage behind it of the first vane 135. The vane 135 associated with the follower carrier 27 may be of wider dimension to insure that the window opening in which the track 131 fits has as complete closure as possible.

Figure 15:
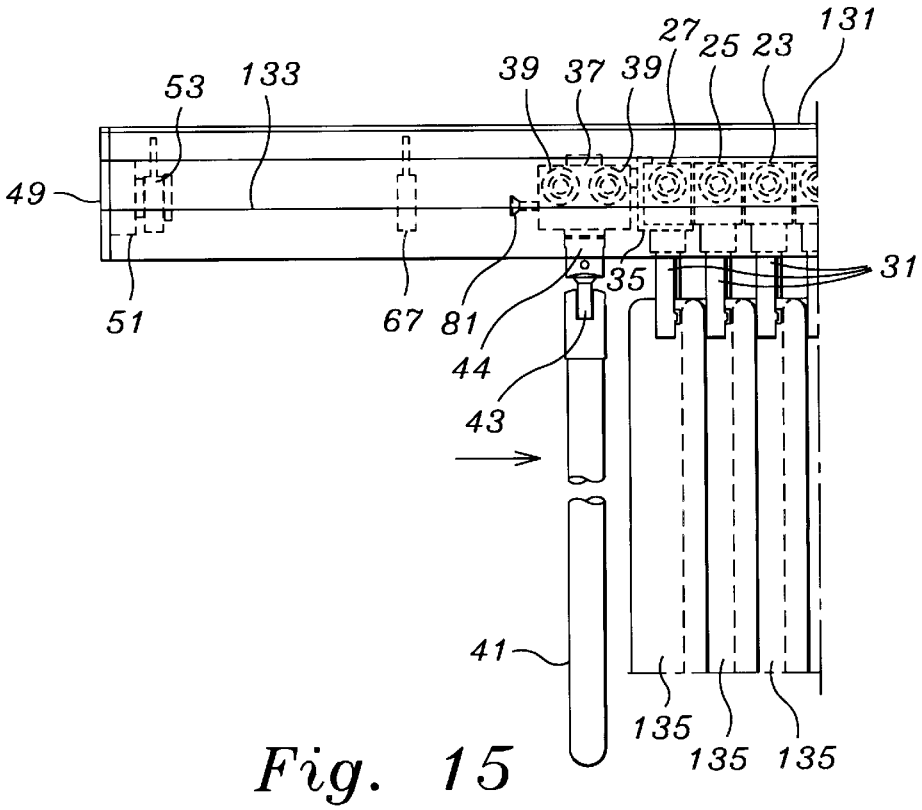
FIG. 15 is a plan view of FIG. 14, but shown in the open position.

Referring to FIG. 15, the configuration of FIG. 14 is shown in the open position. Note that second flat member 67 has been allowed to travel freely and need not be connected firmly to the lead carrier 37.

Figure 16:
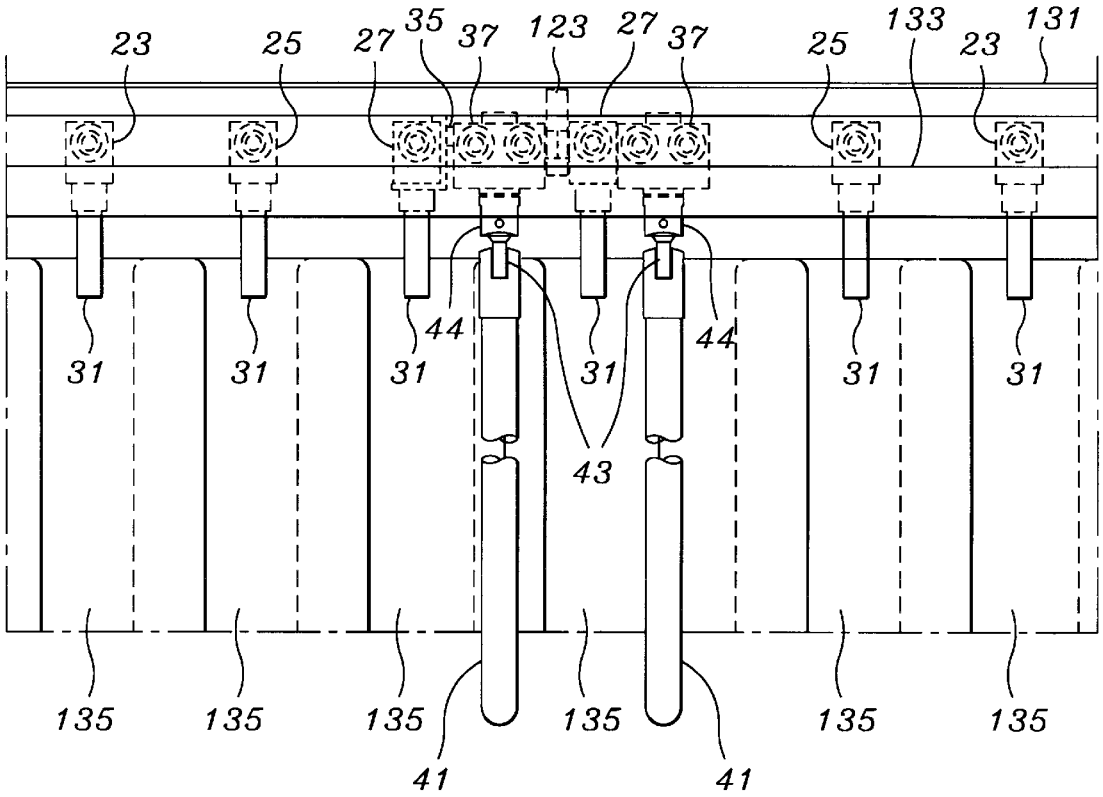
FIG. 16 is a plan view illustrating the invention most closely associated with FIG. 10 in a closed position with a two sided, middle opening and closing configuration.

Referring to FIG. 16, a plan view a two sided configuration in accord with the exploded top view of FIG. 10 is shown. In this configuration, the lead carriers 37 are both fitted with magnets 93. Again, track 131 and its race 133 is present upon which the wheels 29 and 39 ride. For simplicity, the rotatable rod continues not to be shown.

Figure 17:
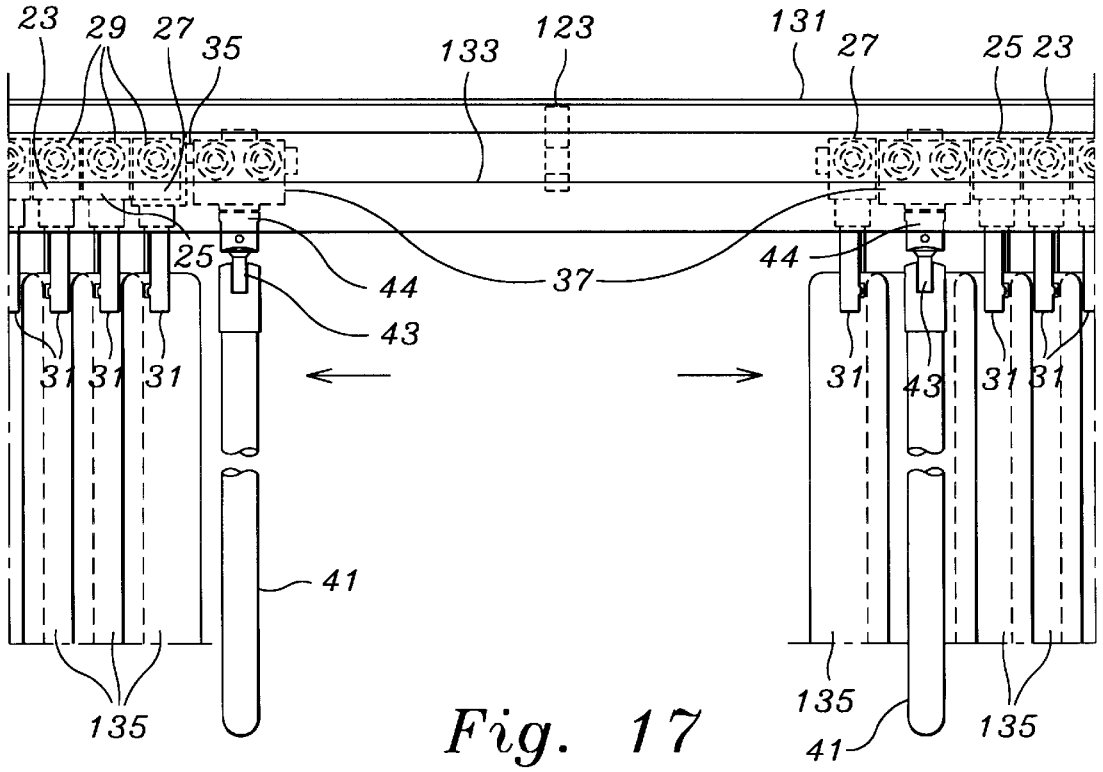
FIG. 17 is a plan view of the middle opening and closing configuration of FIG. 16, but shown in the open position.

Referring to FIG. 17, the configuration of FIG. 16 is shown in the open position. Note that so long as spacing of the follower carriers 23, 25 and 27 and others is proper, no special center marker or stop is needed. Such a center stop could be provided if it was desired to make sure that the additional dimensioning of separation over absolute tolerance was to be distributed evenly.

Figure 18:
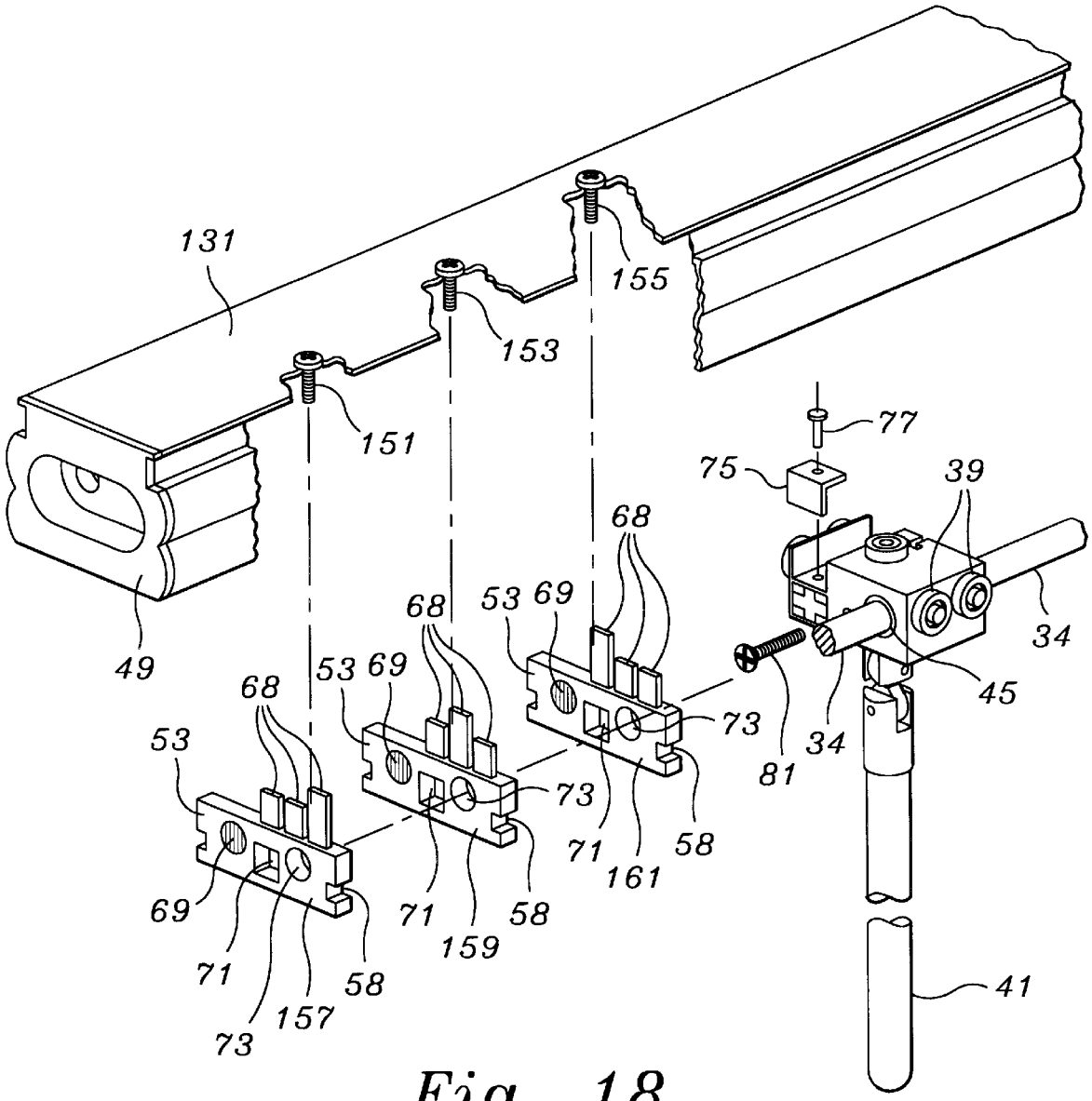
FIG. 18 is a perspective exploded view illustrating the screws in a track which provide a series of stops to spatially distribute a series of second flat members.

FIG. 18 illustrates a drop-down exploded view of the track 131 having a series of three screws 151, 153, & 155 spaced along its length, but at differing positions across the width of the track 131. Below the track 131 is a series of second flat members 157, 159, and 151 which have differing ones of the upper members 68 in the upward-most position. Normally, these three members would be magnetically attracted to each other and lightly held together by the magnets 69, as well as held to the lead carrier 37 via attraction to the plate 75. However, as the lead carrier 37 is moved along the track, the second flat member 157 engages the screw 151 and stays at screw 151. The two second flat members 159 and 161 continue to be moved along behind the lead carrier 37 until the second flat member 158 and its upper portion 68, especially the middle finger, engages screw 153 and is then stopped and separated from second flat member 161, remaining behind to support the rotatable rod 34. Likewise, as the lead carrier 37 and second flat member 161 are moved along, engagement of the upper portion 68 of the second flat member 161 with the screw 155 with the screw 155, the second flat member 161 is left behind to support the rotatable rod 34. When the vertical blinds are to be closed, the lead carrier 37 is moved back to the left, sequentially collecting the second flat members 161, 159, and 157 before it and then spatially compressing these members against the end cap 49 which positively holds the lead carrier 37 in a shut or closed position.

Figure 19:
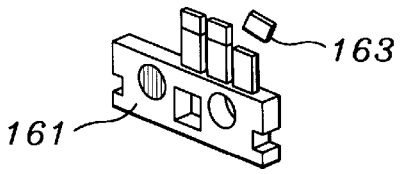
FIG. 19 illustrates a single second flat member in position to be modified by having a rightmost finger of its upper projection removed to leave other fingers free to engage a stop screw.

Referring to FIG. 19, the upper portion 68 of second flat member 161 is modifiable by the installer to have only the left projection extend upward. As shown in FIG. 19, a discard piece 163 is being separated leaving two fingers up. A subsequent separation of the middle finger will leave only the left finger extended upwardly.

While the present invention has been described in terms of a vertical blind system, one skilled in the art will realize that the structure and techniques of the present invention can be applied to many similar appliances. The present invention may be applied in any situation where spacing and tolerance distributions are desired to be controlled and supplemented with an absolute and easy to use opening and closing mechanism.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A positive closure system for a vertical blind comprising:

an elongate track;

a rotatable rod rotationally supported by said elongate track;

a lead carrier having a wand for manual turning input and an internal fitting for translating manual turning input into rotation of said rotatable rod;

a plurality of follower carriers each having an internal rotatable sleeve engaging said rotatable rod, and a rotatable blind support linked to turn in response to rotation of said rotatable rod;

a magnetically attractable plate having a vertical surface and attached to said lead carrier;

a magnetically attractable screw extending from said lead carrier;

an end cap secured by said elongate track;

a first flat member attached to said end cap and carrying a first magnet and having a first aperture surrounding said rotatable rod and a second aperture;

at least one second flat member having a first aperture surrounding said rotatable rod, a second aperture and a second magnet, and movable to a position adjacent said first flat member; and wherein said magnetically attractable screw extends through said second aperture of said at least one second flat member engaging with said first magnet, and wherein said second magnet engages said magnetically attractable plate when said lead carrier is brought sufficiently close to said end cap to hold said lead carrier positively adjacent said end cap.

2. The positive closure system of claim 1 where said first flat member is connected to said end cap with a magnetically attractive metal member which contacts said second magnet.

3. A positive closure system for a vertical blind comprising:

an elongate track;

a rotatable rod rotationally supported by said elongate track;

a lead carrier having a wand for manual turning input and an internal fitting for translating manual turning input into rotation of said rotatable rod, and carrying an open bore;

a plurality of follower carriers each having an internal rotatable sleeve engaging said rotatable rod, and a rotatable blind support linked to turn in response to rotation of said rotatable rod;

a magnetically attractable screw extending from said lead carrier;

an end cap secured by said elongate track;

a flat member attached to said end cap and carrying a first magnet and having a first aperture surrounding said rotatable rod and a second aperture;

a magnetically attractive attachment member securing said flat member to said end cap;

a second magnet carried within said open bore of said lead carrier; said lead carrier movable to a position adjacent said flat member such that said magnetically attractable screw engages with said first magnet, and wherein said second magnet engages said magnetically attractive attachment member securing said flat member to said end cap to hold said lead carrier positively adjacent said end cap.

4. The positive closure system of claim 3 wherein said open bore of said lead carrier has a cross shaped cross-sectional shape and said second magnet matches said cross shaped cross-sectional shape.

5. A positive closure system for a vertical blind comprising:

an elongate track;

a rotatable rod rotationally supported by said elongate track;

a lead carrier having a wand for manual turning input and an internal fitting for translating manual turning input into rotation of said rotatable rod, and carrying an open bore;

a plurality of follower carriers each having an internal rotatable sleeve engaging said rotatable rod, and a rotatable blind support linked to turn in response to rotation of said rotatable rod;

an end cap secured by said elongate track and having a depression;

a first magnet carried within said depression of said end cap;

a second magnet carried within said open bore of said lead carrier; said lead carrier movable to a position adjacent said end cap such that said second magnet sufficiently engages said first magnet to hold said lead carrier positively adjacent said end cap.

6. The positive closure system of claim 5 wherein said open bore of said lead carrier has a cross shaped cross-sectional shape and said second magnet matches said cross shaped cross-sectional shape.

7. The positive closure system of claim 6 wherein said depression of said end cap is oval and wherein said second magnet has a "D" shaped peripheral surface.

8. A positive closure system for a vertical blind comprising:

an elongate track;

a rotatable rod rotationally supported by said elongate track;

a lead carrier having a wand for manual turning input and an internal fitting for translating manual turning input into rotation of said rotatable rod, and carrying an open bore;

a plurality of follower carriers each having an internal rotatable sleeve engaging said rotatable rod, and a rotatable blind support linked to turn in response to rotation of said rotatable rod;

an end cap secured by said elongate track;

a magnetically attractive metal member carried by said end cap;

a magnet carried within said open bore of said lead carrier; said lead carrier movable to a position adjacent said end cap such that said magnet sufficiently engages said magnetically attractive metal member to hold said lead carrier positively adjacent said end cap.

9. The positive closure system of claim 5 wherein said open bore of said lead carrier has a cross shaped cross-sectional shape and said magnet matches said cross shaped cross-sectional shape.

10. A positive closure system for a vertical blind comprising:

an elongate track;

a rotatable rod rotationally supported by said elongate track;

a lead carrier having a wand for manual turning input and an internal fitting for translating manual turning input into rotation of said rotatable rod;

a magnetically attractable plate having a vertical surface and attached to said lead carrier;

a plurality of follower carriers each having an internal rotatable sleeve engaging said rotatable rod, and a rotatable blind support linked to turn in response to rotation of said rotatable rod;

an end cap secured by said elongate track and having a depression;

a magnet carried within said depression of said end cap;

said lead carrier movable to a position adjacent said end cap such that said magnet sufficiently engages said magnetically attractable plate to hold said lead carrier positively adjacent said end cap.

11. The positive closure system of claim 10 wherein said depression of said end cap is oval and wherein said second magnet has a "D" shaped peripheral surface.

12. A positive closure system for a vertical blind comprising:

an elongate track having a first end and a second end;

a first rotatable rod rotationally supported by said elongate track;

a first lead carrier having a first side and a second side having a first wand for manual turning input and an internal fitting for translating manual turning input into rotation of said first rotatable rod, and carrying an open bore at said first side;

a first magnet carried within said open bore of said first lead carrier;

a second rotatable rod rotationally supported by said elongate track and independently rotatable with respect to said first rotatable rod;

a second lead carrier having a first side and a second side having a second wand for manual turning input and an internal fitting for translating manual turning input into rotation of said second rotatable rod, and carrying an open bore at said first side;

a second magnet carried within said open bore of said second lead carrier;

a first plurality of follower carriers each having an internal rotatable sleeve engaging said rotatable rod, and a rotatable blind support linked to turn in response to rotation of said rotatable rod and distributed from said second side of said first lead carrier;

a second plurality of follower carriers each having an internal rotatable sleeve engaging said rotatable rod, and a rotatable blind support linked to turn in response to rotation of said rotatable rod and distributed from said second side of said second lead carrier; said first sides of said first and second lead carriers movable to a position adjacent each other such that said first and second magnets sufficiently engage to hold said first and second lead carriers positively adjacent each others to enable said vertical blind system to close away from said ends of said elongate track.

* * * * *